US005643706A

United States Patent [19]

Brillson et al.

[11] Patent Number: 5,643,706

[45] Date of Patent: Jul. 1, 1997

[54] PROCESS FOR PREPARING ELECTROCONDUCTIVE MEMBERS

[75] Inventors: Leonard J. Brillson, Pittsford; Scott M. Silence, Penfield; Michael J. Duggan; Ann M. Kazakos, both of Webster, all of N.Y.

[73] Assignee: Xerox Corporation, Stamford, Conn.

[21] Appl. No.: 565,544

[22] Filed: Nov. 30, 1995

[51] Int. Cl.[6] ..... G03G 5/00; B05D 3/00

[52] U.S. Cl. ..... 430/127; 430/130; 427/554

[58] Field of Search ..... 430/127, 130; 427/554

[56] References Cited

U.S. PATENT DOCUMENTS

| | | | |
|---|---|---|---|
| 2,807,233 | 9/1957 | Fitch . | |
| 3,043,684 | 7/1962 | Mayer . | |
| 3,267,840 | 8/1966 | Honma et al. . | |
| 3,328,193 | 6/1967 | Oliphant et al. . | |
| 3,598,580 | 8/1971 | Baltazzi et al. . | |
| 3,625,146 | 12/1971 | Hutchison | 101/153 |
| 3,630,591 | 12/1971 | Eastman | 355/3 |
| 3,684,364 | 8/1972 | Schmidlin | 355/3 |
| 3,691,993 | 9/1972 | Krause et al. | 118/637 |
| 3,702,482 | 11/1972 | Dolcimascolo et al. | 346/74 ES |
| 3,781,105 | 12/1973 | Meagher | 355/3 |
| 3,924,943 | 12/1975 | Fletcher | 355/3 R |
| 4,265,990 | 5/1981 | Stolka et al. | 430/59 |
| 5,021,309 | 6/1991 | Yu | 430/58 |
| 5,153,023 | 10/1992 | Orlowski et al. | 427/555 |
| 5,200,286 | 4/1993 | Yashiki et al. | 430/58 |
| 5,268,259 | 12/1993 | Sypula | 430/311 |
| 5,337,127 | 8/1994 | Imaue | 355/271 |
| 5,347,353 | 9/1994 | Fletcher | 355/326 R |
| 5,372,904 | 12/1994 | Yu et al. | 430/64 |

OTHER PUBLICATIONS

H.M. Phillips et al., "Excimer–Laser–Induced Electric Conductivity in Thin–Film $C_{60}$," Applied Physics, A57, pp. 105–107 (1993).

R. Srinivasan et al., "Generation of Electrically Conducting features in Polyimide (Kapton) films with Continuous Wave, Ultraviolet Laser Radiation," Appl. Phys. Lett. 63, No. 24, Dec. 13, 1993.

T. Feurer et al., "Ultraviolet–Laser–Induced Permanent Electrical Conductivity In Polyimide," Appl. Phys., A56, pp. 275–281, (1993).

H.M. Phillips et al., "Submicron Electrically Conducting Wires Produced In Polyimide By Ultraviolet Laser Irradiation," Appl. Phys. Lett., vol. 62, No. 20, May 17, 1993.

H.M. Phillips et al., "Sub–100 nm Lines Produced By Direct Laser Ablation In Polyimide," Appl. Phys. Lett., vol. 58, No. 24, Jun. 1991.

M. Schumann et al., "Permanent Increase Of The Electrical Conductivity of Polymers Induced by Ultraviolet Laser Radiation," Appl. Phys. Lett., vol. 58, No. 5, Feb. 4, 1991.

N. Quick, "Direct Conversion Of Conductors On Ceramic Substrates," ISHM '90 Proceedings, pp. 36–41, 1990.

*Primary Examiner*—Mark Chapman

*Attorney, Agent, or Firm*—Oliff & Berridge; Eugene O. Palazzo

[57] ABSTRACT

A method for forming an electroconductive member such as an imaging member, an intermediate belt, and an electroded donor or bias transfer roll for electrostatographic development includes the steps of forming a roll having a layer of an insulating material and altering an electrical property of the insulating material by irradiating the insulating material with a laser beam.

20 Claims, 2 Drawing Sheets

PROCESS FOR PREPARING ELECTROCONDUCTIVE MEMBERS

BACKGROUND OF THE INVENTION

This invention relates generally to a process for preparing electroconductive members such as imaging members and electroded donor rolls or electroded bias transfer rolls. This invention particularly concerns fabrication of such electroconductive members having a conductive layer or having an integral electrode pattern wherein the electrode pattern comprises conductive structures within the insulating polymer or ceramic layer, formed by direct irradiation of the insulating material. The present invention also relates to a process for changing the electrical properties, such as conductivity, of an insulating material layer of an electroconductive member such as an imaging member, a donor roll or a bias transfer roll.

Generally, the processes of electrostatographic imaging and electrophotographic printing include the steps of charging a photoconductive imaging member to a substantially uniform potential so as to sensitize the photoconductive surface thereof. The charged portion of the photoconductive imaging member is exposed to an image of an original document being reproduced, such as a visible image of an original document being reproduced or a computer-generated image written by, for example, a raster output scanner. This records an electrostatic latent image on the photoconductive imaging member corresponding to the original document or computer-generated image. The recorded latent image is then developed by bringing oppositely charged toner particles into contact with it. This forms a toner powder image on the imaging member that is subsequently transferred to a substrate, such as paper. Finally, the toner powder image is permanently affixed to the substrate in image configuration, for example by heating and/or pressing the toner powder image.

Transfer of the latent image from the imaging member to the recording substrate is most commonly achieved by applying electrostatic force fields in a transfer nip sufficient to overcome the forces holding the toner to the imaging member and to attract most of the toner to transfer it onto the recording substrate. These transfer fields are generally provided in one of two ways, by ion emission from a transfer corona generator onto the back of the copy sheet, as described in U.S. Pat. No. 2,807,233, or by a DC charged biased transfer roller or belt rolling along the back of the copy sheet. Examples of bias roller transfer systems are described in U.S. Pat. Nos. 3,781,105, 2,807,233, 3,043,684, 3,267,840, 3,328,193, 3,598,580, 3,625,146, 3,630,591, 3,684,364, 3,691,993, and 3,702,482. Further examples of a biased transfer roller are described in U.S. Pat. Nos. 3,924,943 and 5,337,127.

A suitable developer material may be a two-component mixture of carrier particles having toner particles triboelectrically adhered thereto. The toner particles are attracted to and adhere to the electrostatic latent image to form a toner powder image on the imaging member surface. Suitable single component developers are also known. Single component developers comprise only toner particles; the particles have an electrostatic charge (for example, a triboelectric charge) so that they will be attracted to, and adhere to, the latent image on the imaging member surface.

There are various known forms of development systems for bringing toner particles to a latent image on an imaging member surface. One form includes a magnetic brush that picks up developer from a reservoir through magnetic attraction and carries the developer into proximity with the latent image. In a modification of the magnetic brush apparatus, known as hybrid development, the magnetic brush does not bring toner directly to the imaging member surface, but transfers toner to a donor roll that then carries the toner into proximity with the latent image. In single component scavengeless development, a donor roll is used with a plurality of electrode wires closely spaced from the donor roll in the development zone. An AC voltage is applied to the wires to form a toner cloud in the development zone and the electrostatic fields generated by the latent image attract toner from the cloud to develop the latent image. In a hybrid scavengeless development system, the method of development with a donor roll is the same as in single component scavengeless development, except that a magnetic brush is first used to load the donor roll with toner particles. In this system, the donor roll and magnetic brush are electrically biased relative to one another; thus toner is attracted to the donor roll from the magnetic brush. The electrically biased electrode wires then detach toner from the donor roll, forming a toner cloud in the development zone and thereby developing the latent image.

In single component jumping development, an AC voltage is applied to the donor roll, causing toner to be detached from the roll and projected towards the imaging member surface. The toner is attracted by the electrostatic fields generated by the latent image and the latent image is developed. Variants of these development systems may be used with single component or two-component developers.

An electrophotographic imaging member for use in these processes may be provided in a number of forms. For example, the imaging member may be a homogeneous layer of a single material such as vitreous selenium, or it may be a composite layer containing a photoconductor and another material. One type of composite imaging member comprises a layer of finely divided particles of a photoconductive inorganic compound dispersed in an electrically insulating organic resin binder. U.S. Pat. No. 4,265,990 discloses a layered photoreceptor having separate photogenerating and charge transport layers. The photogenerating layer is capable of photogenerating holes and injecting the photogenerated holes into the charge transport layer.

As more advanced, higher speed electrophotographic copiers, duplicators and printers were developed, degradation of image quality was encountered during extended cycling. Moreover, complex, highly sophisticated duplicating and printing systems operating at very high speeds have placed stringent requirements on photoreceptors, including narrow operating limits. For example, the numerous layers found in many modern photoconductive imaging members must be highly flexible, adhere well to adjacent layers, and exhibit predictable electrical characteristics within narrow operating limits to provide excellent toner images over many thousands of cycles. One type of multilayered photoreceptor that has been employed as a belt in electrophotographic imaging systems comprises a substrate, a conductive layer, a blocking layer, a charge generating layer, a charge transport layer and a conductive ground strip layer adjacent to one edge of the imaging layers. This photoreceptor may also comprise additional layers such as an anti-curl back coating, an adhesive layer and an optional overcoating layer.

Several of these types of photoreceptors are disclosed in, for example, U.S. Pat. Nos. 5,021,309, 5,200,286 and 5,372,904.

In multi-color electrostatographic printing, a photoconductive intermediate transfer belt is used. Rather than forming a single latent image on a photoconductive surface, successive latent images corresponding to different colors must be created. Each single color latent electrostatic image is developed with a corresponding different colored toner, and thus the process is repeated for a plurality of cycles. Each single-color toner image is then superimposed over the previously transferred single-color toner image when it is transferred to the recording substrate such as a copy sheet. This creates a multilayered toner image on the copy sheet. One way to transfer each of the several latent images is to develop one or more of the latent images on a single intermediate transfer belt, rather than on separate photoreceptors, and then transfer the latent images from the intermediate belt to the recording substrate. Such a photoconductive intermediate transfer belt is disclosed in, for example, U.S. Pat. No. 5,347,353.

Generally, as described above, a donor roll is used in many electrostatographic development systems. The donor roll is used to transport toner particles, for example, from a magnetic brush to the development zone to be applied to the surface of a photoreceptor. A purpose of the donor roll is to transfer the toner to the photoreceptor without significantly disturbing or removing toner particles already on the surface of the photoreceptor. Thus, for example, a donor roll is preferred in color imaging processes where all of the toner particles are not applied to the photoreceptor at the same time.

In order to function properly as an electroconductive member, it is necessary that the electroconductive layer or layers of the member have a specific RC time constant. The RC time constant is the product of the resistance and capacitance of the roll, and indicates the time required for charging and discharging the roll. That is, the member must be capable of dissipating an applied charge, such as an electrostatic charge, within a specified time range. Generally, the time range varies from about 0.06 to about 1.5 msec, with the time constant being defined by the resistance and capacitance of the imaging member coating or by the resistivity and dielectric constant of the coating. The electroconductive member materials, in addition to retaining or dissipating an applied charge, must also have good wear resistance, must be compatible with the toner to be used in the development system, and must have good bond strength with any substrate or other layers used in the imaging member.

The RC time constant is also important in the context of imaging members because, for example, the electrical characteristics of a layer of the imaging member must be properly adjusted to ensure imagewise transfer and development of a latent image. For example, whereas it may be necessary for one layer of the imaging member to retain a charge for a longer period of time, other layers may require faster discharge and transport of charges.

Bias transfer rolls must similarly have strictly determined electrical properties in order to properly transfer an image to the recording substrate. For example, the difficulties of successful image transfer are well known. In the pre-transfer (pre-nip) region, before the recording substrate (copy paper) contacts the latent image, if the transfer fields are too high the image is susceptible to premature transfer across the air gap, leading to decreased resolution or fuzzy images. Further, if ionization is present in the pre-nip air gap due to high fields, it may lead to strobing or other image defects, loss of transfer efficiency, and a lower latitude of system operating parameters. However, in the directly adjacent nip region itself, the transfer field should be as large as possible (greater than approximately 20 volts per micron) to achieve high transfer efficiency and stable image transfer. In the next adjacent post-nip region, at the photoconductor/copy sheet separation (stripping) area, if the transfer fields are too low hollow characters may be generated. On the other hand, improper ionization in the post-nip region may cause image instability or copy sheet detacking problems. Variations in ambient conditions, copy paper, contaminants, etc., can all affect the necessary transfer parameters. The bias roll material resistivity and paper resistivity can change greatly with humidity, etc. Further, conduction of the bias charge from the bias transfer roller is also greatly affected by the presence or absence of the copy paper between it and the imaging surface. To achieve these different transfer field parameters consistently, and with appropriate transitions, is difficult.

In the past, the properties of the electroconductive roll coatings have been achieved by using a coating material, generally a semiconducting material or a mixture of a conductive material dispersed in a binder resin, having specific electrical properties such as resistivity and dielectric constant. As necessary, conductive wiring was then applied to the roll as a separate step or steps. Thus the semiconducting material was selected to have a predetermined RC time constant. A problem with this method, however, is that small variations in material formulation and/or the coating process can result in large variations in the resultant RC time constant of the roll. As a result, reproducibility of properties may be difficult to achieve and the development process and resultant image may be adversely affected.

Furthermore, several problems exist with conventional donor rolls in many of these development systems when some toner materials are used. It has been found that for some toner materials, the tensioned electrically biased wires in self-spaced contact with the donor roll tend to vibrate. This vibration may cause non-uniform solid area development of the resultant developed image. Furthermore, there is a possibility that debris within the development system can momentarily lodge on the wires. Such debris can cause streaking of the resultant print image. Thus, it would appear to be advantageous to replace the externally located electrode wires with electrodes integral to the donor roll. In addition, the removal of electrode wires from the development zone would obviate the need for a structure to maintain tension in the wires and to position the wires within the development zone.

One such method of forming integral electrodes in a donor roll, thereby forming an electroded roll, is disclosed, for example, in U.S. Pat. No. 5,268,259 to Sypula. In Sypula, the electrodes are formed in the donor roll by a process comprising: (a) providing a cylindrically shaped insulating member; (b) coating the insulating member with a light sensitive photoresist; (c) patterning the photoresist by exposure to light, resulting in a first photoresist portion corresponding to the electrode pattern and a second photoresist portion; (d) removing the first photoresist portion, thereby exposing a portion of the insulating member; and (el depositing conductive metal on the portion of the insulating member where the first photoresist portion has been removed, resulting in an electrode pattern that is capable of being electrically biased to detach toner particles from the donor roll.

Another method for forming electrode patterns on a substrate, using an electroless process, is disclosed in U.S. Pat. No. 5,153,023 to Orlowski et al. The process allows for the formation of at least one electrically conductive path in a plastic substrate. The process comprises: (a) providing a thermoplastic substrate having a melting point below 325° C.; (b) coating the substrate with a precursor of a catalyst for the electroless deposition of conductive metals, the catalyst precursor having a decomposition temperature below the melting point of the thermoplastic substrate and within the temperature range where the thermoplastic substrate softens; (c) heating the portion of the coated thermoplastic substrate corresponding to the desired conductive path to a temperature sufficient to decompose the catalyst precursor to a catalyst and soften the thermoplastic substrate; and (d) depositing conductive metal by electroless deposition on the heated portion of the thermoplastic substrate to form a conductive path. In the process, the substrate, catalyst precursor and temperature are selected such that, upon heating, the precursor decomposes to a catalyst and the thermoplastic substrate softens and at least partially melts without substantial decomposition. This softening enables the catalyst to penetrate the surface of the thermoplastic substrate and become anchored therein. The catalyst then provides nucleation sites for the subsequent electroless deposition of conductive metal. The substrate containing the electrically conductive path may be a planar member, a two-sided circuit board, or a frame or structural member in a machine such as an automatic reprographic machine, which includes office copiers, duplicators and printers.

An electrode pattern may also be formed by evaporation, sputtering, spraying conductive materials through a mask, or by electrodepositing through a previously patterned conductive surface. These and other methods are known in the art.

A process of irradiating a polymer to form patterns of permanently increased electrical conductivity is described in Schumann et al., "Permanent Increase of the Electrical Conductivity of Polymers Induced by Ultraviolet Laser Radiation," *Appl. Phys. Lett.*, Vol. 58(5), 428–30 (4 February 1991); Phillips et al., "Sub-100 nm Lines Produced Ablation in Polyimide," *Appl. Phys. Lett.*, Vol. 58(24), 2761–63 (17 June 1991); Phillips et al., "Submicron Electrically Conducting Wires Produced in Polyimide by Ultraviolet Laser Irradiation," *Appl. Phys. Lett.*, Vol. 62(20), 2572–74 (17 May 1993); Srinivasan et al., "Generation of Electrically Conducting Features in Polyimide (Kapton™) Films With Continuous Wave, Ultraviolet Laser Radiation," *Appl. Phys. Lett.*, Vol. 63(24), 3382–83 (13 December 1993); Phillips et al., "Excimer-Laser-Induced Electric Conductivity in Thin-Film $C_{60}$," *Appl. Phys. A*, Vol. 57, 105–07 (1993); and Feurer et al., "Ultraviolet Laser-induced Permanent Electrical Conductivity in Polyimide," *Appl. Phys. A*, Vol. 56, 275–81 (1993). The references generally discuss the formation of conducting lines (wires) in a polyimide material using cw (argon), excimer, and UV laser irradiation. The references disclose that such processes may be useful in semiconductor and integrated circuit processing applications as a means to replace the wet resist production processes. The references do not disclose application of the process to the production of electroconductive members for use in electrostatographic imaging processes.

A similar process is disclosed in N. R. Quick, "Direct Conversion of Conductors in Ceramic Substrates," ISHM Proceedings (1990). The disclosed process uses a Nd:YAG laser system with an emission wavelength of 1064 nm to generate nonmetallic electrode lines in alpha-silicon carbide and aluminum nitride substrates.

A problem with the methods currently used to form electrode patterns in imaging members such as electroded donor rolls and bias transfer rolls is the difficulty in implementing those processes on a commercial scale. For example, the multi-step nature of the processes, combined with the exacting product specifications and process control required, make the processes costly and difficult to implement. The processes also raise the problem of defects and contamination due to the numerous contacting steps necessary in the processes. A need therefore continues to exist in the field for improved processes for forming electroconductive members in general, and particularly for forming electrode patterns on members such as donor and bias transfer rolls.

There also continues to be a need in the art for a means to alter the electrical properties such as conductivity of an insulating polymer or ceramic layer of an electroconductive member so as to set and tune the RC time constant of the member. This is necessary to provide desired charge dissipation and other properties of the electroconductive member. In addition to being able to establish set properties in the electroconductive member layer, there is a need for a process that can provide more reproducible and constant results from one member to the next in the production process.

SUMMARY OF THE INVENTION

The present invention provides a method for forming an electroconductive member for electrostatographic development, comprising (a) forming a roll having a layer of an insulating material and (b) altering an electrical property of said insulating material by irradiating the insulating material with a laser beam, before or after said step (a).

DETAILED DESCRIPTION OF PREFERRED EMBODIMENTS

Figure 1:
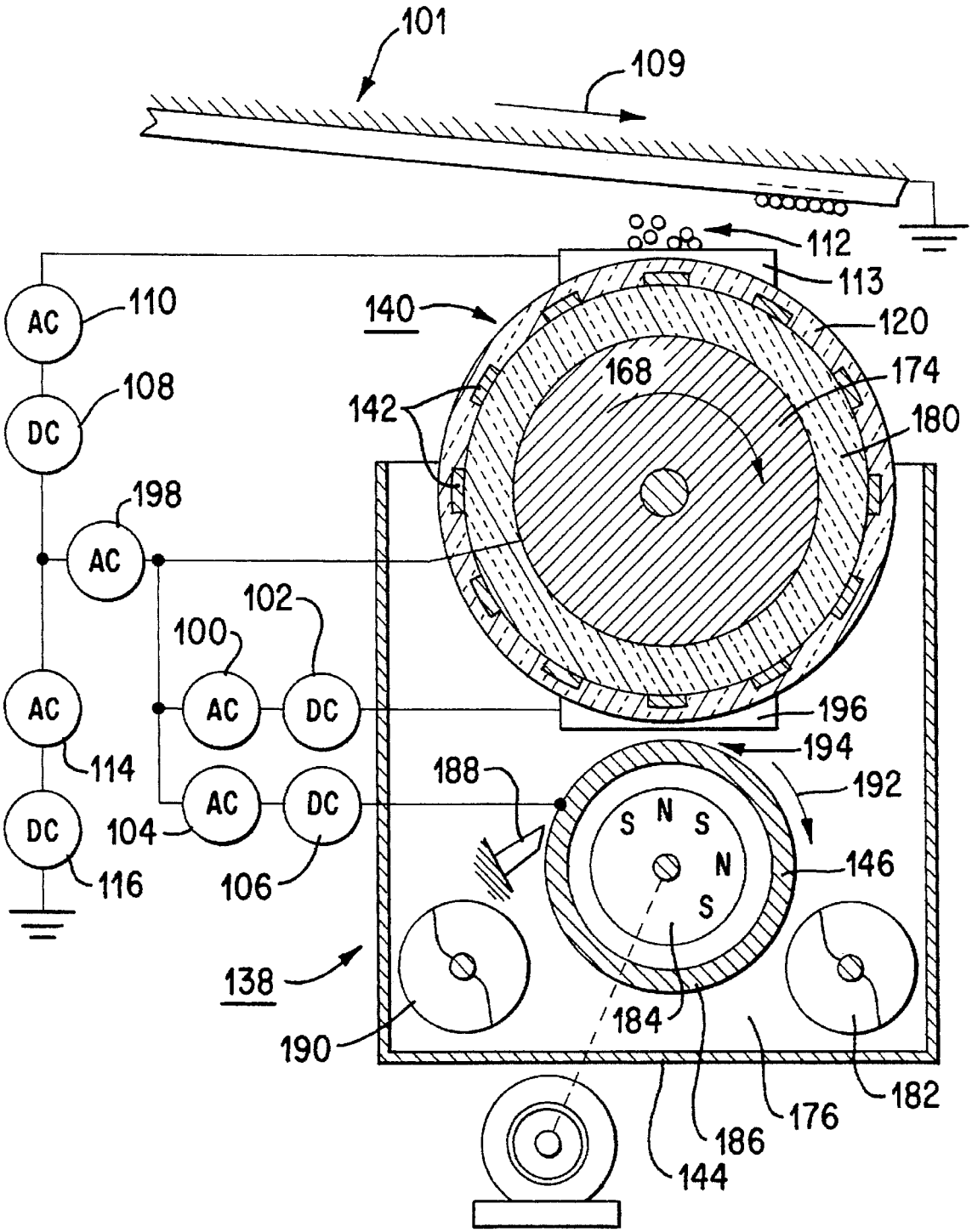
FIG. 1 is a schematic diagram depicting an illustrative electrostatographic developer unit having a donor roll according to the present invention.

By the process of the present invention, an electroconductive member such as an imaging member or an electroded donor or bias transfer roll may be produced having a layer of an insulating polymer or ceramic material where the electrical properties of the layer, such as conductivity, resistivity, and dielectric constant, are altered by selectively irradiating the insulating material. The process may be used to alter the bulk properties of the entire insulating material layer, may be used to alter the properties of only a portion of the insulating material layer (such as the surface of the layer), or may be used to form a pattern of conductive portions in the layer. For example, the conductive portions may be in the form of randomly spaced "islands" or may be a conductive pattern similar to a conductive wiring network.

In embodiments, the electroconductive member may generally be a cylindrically shaped member. The electroconductive member may be of any suitable effective length and diameter as necessary for a given application. For example, it is preferred that a donor roll be as wide as the imaging member to which toner particles are to be delivered, and accordingly the imaging member is preferred to be at least as wide as the print substrate such as paper to which the final toner image is to be transferred. The electroconductive member should also be of an effective diameter to permit efficient transport and transfer of the toner particles. Although a specific diameter is not critical, the size of the electroconductive member and other imaging device components impacts the size and efficiency of the entire imaging device, and therefore smaller diameter members are preferred. For example, a typical donor roll preferably is of a length of from about 13 to about 16 inches, and of a diameter of from about 0.75 to about 1.25 inches. However, the electroconductive member is not limited to these specifications, and may be increased or decreased in size to meet specific operational requirements, as well known to one skilled in the art. For example, the dimensions may readily be adjusted based on considerations such as use in low, medium, or high speed printing equipment.

Although the discussion herein focuses on cylindrically shaped electroconductive members, those being the most commonly used in commercial applications, the disclosure applies equally to the formation of electroconductive members in the form of endless belts, such as an intermediate transfer belt. For example, the insulating material layer may be formed as the surface layer on a flexible substrate to form an endless belt. Accordingly, it is understood that the terms "roll" and "electroconductive member" encompass such embodiments as cylindrically shaped members as well as endless belts.

In embodiments, the process of the present invention may be used to form electroded donor rolls or bias transfer rolls. The donor rolls and bias transfer rolls of the present invention generally comprise an insulating member comprising a dielectric material. For example, such donor rolls are generally known and are described in, for example, U.S. Pat. No. 5,268,259, the entire disclosure of which is incorporated herein by reference. Bias transfer rolls are also generally known and are described in, for example, U.S. Pat. Nos. 3,924,943 and 5,337,127, the entire disclosures of which are incorporated herein by reference.

In embodiments, the insulating member may be entirely comprised of an insulating material. Preferably, however, the insulating member is comprised of a metal core overcoated by a layer of an insulating material. The metal core may be any suitable metal including, for example, nickel, aluminum, steel, iron, mixtures thereof and the like.

In other embodiments of the present invention, the irradiation processes may be used to form imaging member layers. The imaging members may structurally be formed in any of the various forms well known in the art. For example, the imaging member may have as few as two layers (an electrostatographic imaging layer and a substrate layer) or may have as many as eight layers (e.g., an anti-curl layer, a substrate layer, an electrically conductive ground plane layer, a hole blocking layer, an adhesive layer, a charge-generating layer, a charge transport layer and an overcoating layer) or even more. Suitable imaging member structures are described in, for example, U.S. Pat. Nos. 4,265,990, 5,021,309, 5,200,286, 5,347,353 and 5,372,904, the entire disclosures of which are incorporated herein by reference. In any of these various structures, at least one layer of the imaging member is made electroconductive by the processes of the present invention.

In yet further embodiments, the processes of the present invention may be used to form an electroconductive member that functions as a combined imaging member and fusing member. That is, whereas the electrostatographic development devices of the prior art comprise separate imaging members and fusing members, the process of the present invention permits the combination of these two functions into a single member. By the processes of the present invention, the layer or layers of a traditional fusing member may be altered, thereby making it electroconductive and/or photoconductive, such that the latent image may be directly imaged onto the fusing member, which then fuses a toned image to the recording substrate. Accordingly, "imaging member" as used herein also applies to other members that have electroconductive or photoconductive properties.

Thus at least one layer of the electroconductive member of the present invention generally is formed as an insulating layer comprising an insulating material. The insulating material, whether used as a sole component or as an additive in another layer-forming material, may be any suitable dielectric substance including, for example, Buckminsterfullerene; polymeric compositions comprised of polyimide, polybenzimidazole, polyamide-imide such as Torlon Al-10 and Torlon 4203L (both available from Amoco Company), Buckminsterfullerene, polyurethane, nylon, polycarbonate, polyester, polyetherimide, polynitrocellulose, polyolefins such as polyethylene, polypropylene, poly (ethylenevinylacetate) and poly-2-pentene, terpolymer elastomer made from ethylene-propylene diene monomer, polyionomers such as Surlyn™, polyphenylene oxide, polyphenylene sulfide, polysulfone, polyethersulfone, polystyrene, polyvinylidene chloride and polyvinylidene fluoride, mixtures thereof and the like; and the like. Preferably, when a polymer or similar material is used as the insulating material, the insulating material used in the present invention is polyimide, polybenzimidazole, polyamide-imide, Buckminsterfullerene, or a mixture thereof.

In other embodiments of the present invention, however, the insulating material preferably comprises an insulating ceramic material. Suitable insulating ceramic materials include, but are not limited to, silicon carbide, aluminum nitride, silicon nitride, alumina, boron nitride, boron carbide, beryllia, titania, and mixtures thereof. Such insulating ceramic materials are generally excellent electrical insulators and have high thermal dissipation properties, thus making them very suitable for electroconductive members of the present invention. Ceramics are also preferred for their higher stiffness as compared to polymer and metal materials.

The insulating material may be used in any effective amount to form a layer or layers of the electroconductive member of the present invention. In embodiments, one or more layers of the electroconductive member may be altered according to the processes of the present invention. Additionally, a particular electroconductive member layer may be altered throughout the entire layer thickness, or may be modified for different resistivities at different depths of the layer.

That is, in the latter embodiment, the electrical properties of the imaging member layer, such as resistivity, conductivity, RC time constant, etc., can be adjusted to be different at different depths below the surface of the layer. Such adjustment of the electrical properties of the imaging member layer is particularly applicable to the processes of the present invention. Because the penetration of the irradiating laser, and thus the delivered energy, can be varied for example by adjusting the laser's wavelength, the processes of the present invention can be used to differentially alter the electrical properties throughout the entire electroconductive member layer. For example, it may be preferred in imaging members that the surface layer be very resistive, so as to prevent the charge existing on the surface from moving around and shorting or smearing out. At the same time, however, it may be preferred that the underlying layers be less resistive, for example, so that the underlying layers have a selected characteristic relaxation constant to allow for charging and discharging of the layer.

In embodiments where the insulating material is coated on an underlying layer, such as a metal core, the layer of insulating material may be of any effective thickness, preferably ranging from about 10 to about 30 microns, and more preferably from about 15 to about 20 microns. However, this thickness can be adjusted based on the particular application, as known in the art. The insulating material may be coated on an underlying layer by any suitable technique including, for example, spray coating, roll coating, dip coating and the like.

In embodiments of the present invention where the roll has a completely dielectric core, the core material may be an extruded tube or solid rod. The void region inside the dielectric tube material may be optionally filled with any suitable composition, including, for example, rigid polyurethane foam. Where polyurethane foam is used, the foam preferably has a density of, for example, from about 4 to about 25 lbs/cu ft, and more preferably from about 8 to about 16 lbs/cu ft. In these embodiments the foam may serve to reinforce the tube for mechanical properties and/or to dampen vibrations that may occur during preparation of the development device.

Where the electroconductive member is entirely made of a dielectric material, the dielectric roll material may be an extruded tube or solid rod that is provided with end shafts for mounting in the developer application.

In embodiments of the present invention, any suitable irradiation source may be used to irradiate the insulating material layer. Suitable irradiation sources include, but are not limited to, Nd:YAG (neodymium:yttrium aluminum garnet) lasers, ultraviolet lasers, free electron lasers, ion beam lasers, thermal radiation sources such as infrared lasers, visible light lasers, and the like. Specific selection of an irradiation source will depend on the insulating material being processed, penetration depth, spatial resolution, desired surface quality, and economic considerations such as power consumption and processing speed. For example, an infrared Nd:YAG laser is preferred in the processing of ceramic materials, since it delivers higher levels of power to the material, and because the ceramic materials absorb that power better than do polymer materials. However, for processing polymer materials an ultraviolet laser, and particularly an excimer or free electron laser, is preferred. Preferred irradiation sources are ultraviolet lasers, since ultraviolet lasers provide high spatial and depth resolution while allowing commercial processing speeds and high surface quality. Particularly preferred irradiation sources are the Nd:YAG lasers and such ultraviolet lasers as KrF, XeF and ArF excimer lasers, free electron lasers, and continuous wave (cw) argon ion lasers. In other preferred embodiments of the present invention, a free electron laser is used as the irradiation source because this type of laser allows for adjustment in the beam's wavelength, thereby allowing for adjustment in the penetration depth into the insulating material.

In embodiments of the present invention, it is possible to alter the electrical properties of the insulating material, thereby imparting conductive properties to the insulating material, in several different ways. One means of altering the properties is to irradiate the insulating material layer in a single pass at a set processing speed. An alternative is to irradiate the insulating material in multiple passes, for example by increasing the processing speed and using a higher intensity beam strength. In yet other embodiments, the electrical properties may be altered by using a large number of short-duration laser bursts at a given fluence intensity to provide a selected ultimate dosage to the insulating material. Each of these methods is encompassed by the present invention, as well as variants thereof that will be apparent to one skilled in the art based on the present disclosure. In embodiments, the altered electrical properties may be present in the entire layer, or may be formed in a random or set pattern, for example, to form a conductive pattern similar to a conductive wiring network. Additionally, different portions of the insulating material layer may be altered to have different electrical properties from other portions, if desired.

In embodiments of the present invention, it is preferred that the electrical properties of the insulating material layer be adjusted to desired levels by using multiple passes or bursts of the laser source. This method provides for higher spatial and depth resolution of the altered properties. In these embodiments, the electrical properties of the insulating material layer (such as resistivity, capacitance, sheet conductivity, etc.) have been found to be dependent upon the fluence intensity of the laser bursts, and the number of bursts applied to the insulating material layer. The properties also depend upon the frequency of the laser bursts upon the same point of the insulating material film.

Where multiple laser bursts are used to form the conductive pattern, it is preferred that the insulating material be exposed to the laser bursts at a frequency of from about 1 burst per ten seconds to about 100 bursts per second, and preferably from about 1 burst per second to about 10 bursts per second. For example, acceptable results have been obtained using a frequency of 5 bursts per second. For each laser burst, the intensity (fluence) at the insulating material layer should be from about 10 to about 300 $mJ/cm^2$ per pulse. Preferably, the fluence is from about 20 to about 140 $mJ/cm^2$ per pulse, and even more preferably from about 30 to about 80 $mJ/cm^2$ per pulse. Also, to achieve acceptable results, the number of laser bursts should be from about 1,000 to about 6,000. Preferably, the number of laser bursts is from about 1,500 to about 4,000, and even more preferably from about 2,000 to about 3,000. However, pulse frequency, fluence and number of bursts will depend upon the specific insulating material and irradiation source being used, and so values outside of these ranges may be used, as necessary.

Furthermore, it will be readily recognized that the laser processing parameters may be adjusted within broad ranges to account for the specific properties desired, the materials being used, and the laser power. For example, the specific laser processing, such as fluence, intensity, and duration will depend upon such factors as wavelength of the laser, rate of irradiation, pulse width, energy level, and the like. Based on the instant disclosure one skilled in the art can select such processing parameters for a specific insulating material.

In all instances, the spatial and depth resolution also depends upon the wavelength of the irradiation source and the insulating material being processed. Thus, for example, as the wavelength of the irradiation source is increased, the penetration of the radiation into the insulating material is increased. For example, in the case of polyimide, it has been found that a KrF excimer laser having a wavelength of 248 nm has a penetration depth of about 0.1 μm. However, use of a higher wavelength laser, such as a 350–380 nm cw argon ion beam laser, produces conductive areas having a deeper penetration. Similarly, use of a shorter wavelength laser source would result in decreased penetration into the insulating material layer.

Particular process speeds also depend upon the rate of absorption of specific polymers or ceramic materials and their thermal conductivities. Conductive patterning rates will depend in particular upon the energy supplied and required to break bonds photolytically and/or to provide heat and elevate temperature locally (a pyrrolytic process) in the insulating material. Thus, a higher bond strength requires higher energy irradiation (for example from a shorter wavelength irradiation source) for bond breaking. Similarly, a more conductive polymer or ceramic material requires a more rapid rate of heating. That is, the more thermally conductive the material is, the faster the energy from the irradiation source must be delivered to form the patterns in the insulating material.

By the above process, it is possible to produce conductive patterns in the insulating material, where the patterns have extremely high spatial resolution. For example, the process can be used to provide conductive patterns, with the conductive pathways having a width of as narrow as about 35 nm or less, or as broad as 30 μm or even 120 μm or more. In fact, as described below, the process may be used to change the bulk electrical properties of the polymer layer as a whole. Thus, the laser irradiation may be used to form conductive patterns, or to change the bulk electrical properties. That is, the laser processing may be used to alter such bulk electrical properties as bulk resistivity, bulk conductivity and dielectric constant, or such related properties as surface resistivity.

General process and material characteristics for creating conductive patterns in insulating material are described in the following references: Schumann et al., "Permanent Increase of the Electrical Conductivity of Polymers Induced by Ultraviolet Laser Radiation," *Appl. Phys. Lett.*, Vol. 58(5), 428–30 (4 February 1991); Phillips et al., "Sub-100 nm Lines Produced by Direct Laser Ablation in Polyimide," *Appl. Phys. Lett.*, Vol. 58(24), 2761–63 (17 June 1991); Phillips et al., "Submicron Electrically Conducting Wires Produced in Polyimide by Ultraviolet Laser Irradiation," *Appl. Phys. Lett.*, Vol. 62(20), 2572–74 (17 May 1993); and Srinivasan et al., "Generation of Electrically Conducting Features in Polyimide (Kapton™) Films With Continuous Wave, Ultraviolet Laser Radiation," *Appl. Phys. Lett.*, Vol. 63(24), 3382–83 (13 December 1993); Phillips et al., "Excimer-Laser-Induced Electric Conductivity in Thin-Film $C_{60}$," *Appl. Phys. A*, Vol. 57, 105–07 (1993); Feurer et al., "Ultraviolet Laser-Induced Permanent Electrical Conductivity in Polyimide," *Appl. Phys. A*, Vol. 56, 275–81 (1993); N. R. Quick, "Direct Conversion of Conductors in Ceramic Substrates," *ISHM Proceedings* (1990), the entire disclosure of these references being incorporated herein by reference.

In one preferred embodiment of the present invention, the laser irradiation process may be used to form electroded donor or bias transfer members. Such members generally comprise an insulating layer, optionally applied to a rigid substrate and/or optionally coated by a protective material, wherein the insulating layer includes a network or pattern of conductive pathways.

After the electrode pattern is formed in the insulating material layer, the surface of the roll may, in embodiments, be coated with a semi-conductive polymeric material. This semi-conductive polymeric material may be applied over only the electrode pattern, or may preferably be applied over the entire surface of the roll. This semi-conductive polymeric coating may, for example, be utilized to improve the electrical isolation and wear protection of the electrode line pattern. The semi-conductive polymeric material may be of any suitable composition. For example, the semi-conductive material may be comprised of: (1) a charge transport material, such as a phenyldiamine as illustrated in U.S. Pat. No. 4,265,990 to Stolka et al., the disclosure of which is totally incorporated herein by reference; (2) a binder polymer, such as polycarbonate; and (3) a charge injecting enabling material, such as carbon in any of its various forms, metal particles and their oxides, and inorganic materials such as metal halides including ferric chloride. Other representative charge transport materials, binder polymers, and charge injecting enabling materials are illustrated, for example, in U.S. Pat. No. 4,515,882 to Mammino et al., the entire disclosure of which is totally incorporated herein by reference.

A layer of deposited semiconductive material may also be applied to the rolls of the present invention. For example, inorganic semiconducting materials such as gallium arsenide, zinc sulfide and the like, may be applied as an overcoat layer. In particular, in embodiments of the present invention, a semiconducting layer is applied over the patterned layer, wherein the semiconducting material is doped to such an extent that the material remains partially insulative so as not to detract from the conductive nature of the patterned layer.

The electrode pattern formed in the insulating material layer may be of any effective design. For example, in embodiments of donor rolls of the present invention, the electrode patter may be any design that permits the lines of the pattern to be electrically biased to detach toner from the donor roll, thus to form a cloud of toner for development of a latent image with the toner. In embodiments, the electrode pattern may be comprised of a plurality of spaced lines, parallel to the long axis of the donor roll, arranged about the peripheral circumferential surface of the donor roll.

Similarly, in the embodiments of bias transfer rolls of the present invention, the electrode pattern may be any design that permits the generation of sufficiently high electrostatic fields to detach toner particles from a latent image on an imaging member and to attract those particles to the surface of a recording substrate. Similar to donor rolls, the electrode pattern may be comprised of a plurality of spaced lines, parallel to the long axis of the bias transfer roll, arranged about the peripheral circumferential surface of the roll.

In embodiments, the lines of the electrode pattern may be of any effective length. Preferably, the length of each electrode line is at least about half the length of the roll. More preferably, the length of each electrode line is from about ¾ to nearly the full length of the roll. In embodiments, the lines of the electrode pattern may be of any effective width, preferably ranging from about 2 to about 6 mils, and more preferably about 4 mils. Similarly, in embodiments, the lines of the electrode pattern may be of any effective depth, preferably ranging from about 2 to about 10 microns, and more preferably from about 2.5 to about 5 microns in thickness. The lines may be spaced apart at effective intervals, preferably ranging from about 4 to about 8 mils, and more preferably about 6 mils. However, it will be apparent based on the present disclosure that the line dimensions may be adjusted as necessary for a given application.

In embodiments where donor rolls are prepared, the donor roll of the present invention may be formed as any of the donor roll types useful in the art. For example, in embodiments of the present invention the donor roll may be of a scavengeless electrode development configuration, such as illustrated in FIG. 1 herein, where the electrical potential for the toner cloud generation is applied between the electrodes and the conductive and dielectrically coated roll.

In other embodiments, the donor roll may be of a scavengeless interdigitated development configuration. In such donor rolls, the electrical potential is applied between adjacent electrodes that are interdigitated for individual electrical connection and supported on a thick dielectric coated roll. In this arrangement, one set of electrodes is generally connected, with the second set of electrodes being spaced between adjacent electrodes of the first set, and not electrically connected to the first set. The second set of electrically isolated electrodes are generally positioned such that only the one or more electrodes within the development area are electrically biased.

In addition to forming conductive wire patterns in an insulating material layer such as to prepare an electroded donor or bias transfer roll, the process of the present invention, in embodiments, may be used to adjust the bulk properties of the layer as a whole. This is particularly useful for altering the electrical properties of an entire layer for such applications as imaging members. For example, the process of the present invention may be used to precisely set and adjust the resistance and capacitance of an insulating layer to adjust the RC time constant of the layer. In these embodiments, the layer of insulating material may be irradiated to make the layer partially or fully conductive.

In embodiments of the present invention where imaging members are prepared, the imaging member may be comprised of any of a variety of layers well known in the art as useful in imaging member applications. A detailed description of the suitable layers, as well as their composition, properties and means of application, is described in more detail in the U.S. Pat. Nos. 4,265,990, 5,021,309, 5,200,286, 5,347,353 and 5,372,904, incorporated herein by reference above. So long as at least one of the imaging member layers is prepared according to the processes of the present invention, any of these other suitable layers may be incorporated into the imaging member for their known purposes. One skilled in the art, based on the present disclosure, will understand how to alter the imaging members based on the electrical properties of the particular layers.

As described above, the processes of the present invention may be used to form any of the one or more layers of an imaging member. For example, the processes may be used to form a surface layer of the imaging member having specified electrical properties, such as a very high resistivity, and/or for forming sub-surface layers having different electrical properties, such as lower resistivity. For example, the processing may be used to form imaging members where a surface (charge transport) layer has a bulk resistivity of between $10^{12}$ and $10^{14}$ ohm-cm, and a sub-layer has a bulk resistivity of between $10^{6}$ and $10^{10}$ ohm-cm. Alternatively, as described above, the processes of the present invention may be used to differentially alter the electrical properties of an insulating material at various depths, thereby forming essentially several different imaging member layers from a single layer of insulating material.

In embodiments, the insulating material is first coated upon a substrate or underlying layer or is formed directly into a layer or roll, for example by extrusion, as described above, prior to being irradiated. The insulating material may be selected from any of the insulating materials mentioned above. Although it is preferred in embodiments that the properties of the insulating material layer be entirely adjusted by using the irradiation process of the present invention, it is also possible in embodiments to partially adjust the properties of the insulating material prior to coating it on as a layer of the electroconductive member. For example, the properties of the insulating material may be adjusted by adding conductive or other property-regulating particles into the insulating material, as known in the art. For example, the properties of the insulating material may be adjusted by adding charge donating, charge accepting or charge conducting species (i.e. dopants) as individual atoms, molecules, aggregates, agglomerates or particulates to the insulating material. The material may also be pre-heated to modify the charge transporting or screening properties.

Radiation induced values of resistance or resistivity may be varied according to the processes of the present invention over a broad range, for example from $10^{12}$ ohm-cm or higher to $10^{-3}$ ohm-cm or less. Preferably, the resistivity is adjusted to be between about $10^{6}$ ohm-cm and about $10^{10}$ ohm-cm. The processes of the present invention may also be used to vary the dielectric response of the insulating materials. For example, the dielectric constant may be varied over a broad range of, for example, from 2 to 10,000 or more, depending on the particular application and on the insulating material being used. For example, the dielectric constant of a polymer insulating material is preferably between about 2 and 100, more preferably between about 2 and 12. For ceramic insulating materials, the dielectric constant is preferably between about 2 and 1,000, more preferably between about 3 and 200.

In tuning RC time constants of electroconductive members according to the present invention, it is preferred that the entire depth of the insulating material layer is altered. That is, it is preferred in embodiments that the irradiation process be used to adjust the bulk properties of the material, not just the surface properties of the layer. As described above, the penetration depth of the laser may be adjusted by varying the wavelength of the laser. Accordingly, the laser wavelength may be selected and adjusted as necessary to achieve the desired degree of penetration. The wavelength, duration and frequency of irradiation exposure may also be adjusted as necessary to obtain the desired RC time constant for the particular layer of the electroconductive member.

Figure 2:
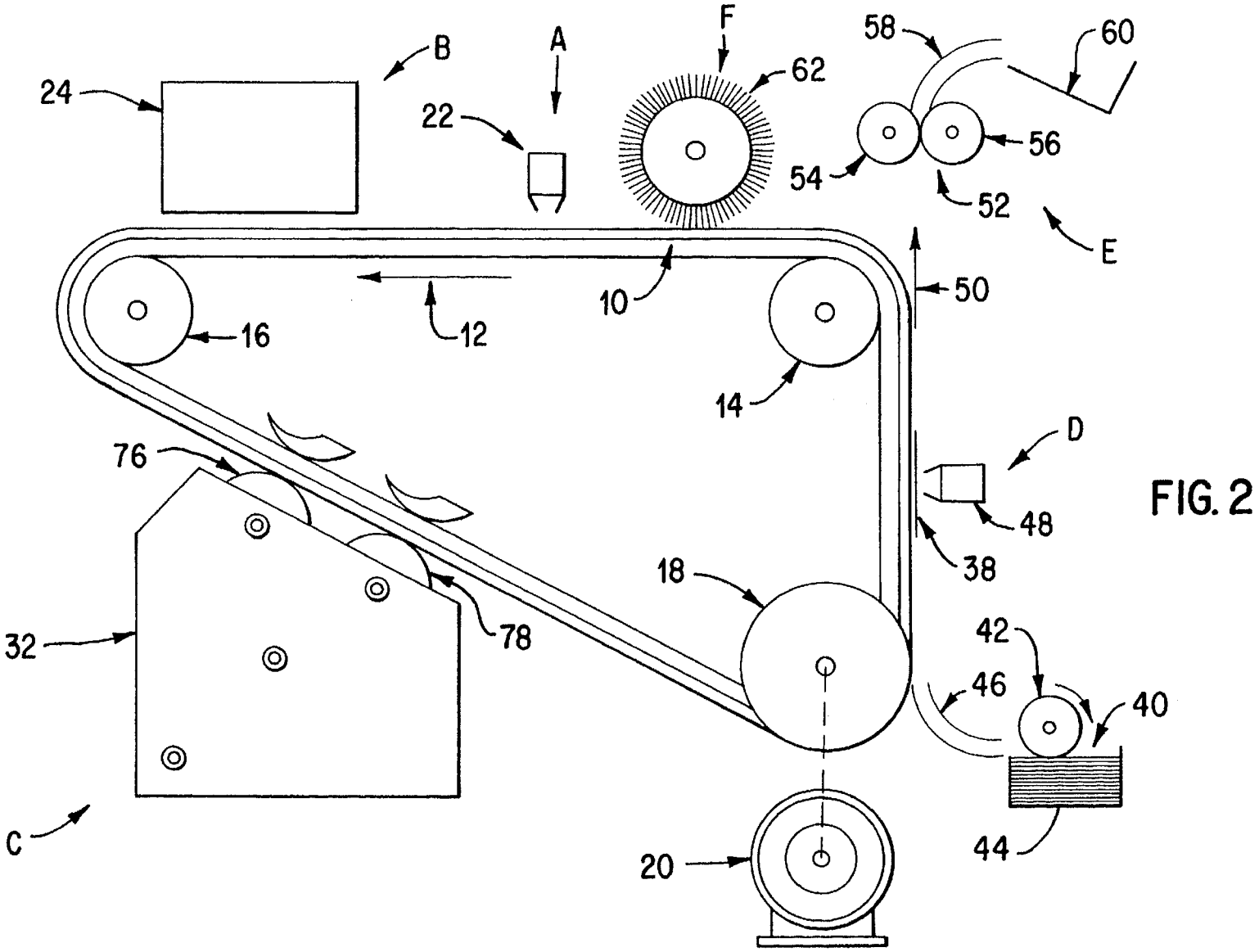
FIG. 2 is a schematic diagram depicting an illustrative electrostatographic imaging machine having an imaging member according to the present invention.

The electrostatographic imaging system using electroconductive members, particularly donor rolls and imaging members, of the present invention will now be described in more detail with reference to the figures. FIG. 1 schematically depicts a representative developer unit using a donor roll of the present invention. FIG. 2 schematically depicts the various components of an illustrative electrophotographic imaging device. It will become evident from the following discussion that the electroconductive members, including drum-shaped imaging members, intermediate belts, combination imaging/fusing members, electroded donor and bias transfer rolls, and the like made by the process of the present invention are equally well suited for use in a wide variety of electrostatographic printing machines, including electrophotographic and ionographic printing machines. Because the various processing stations and elements employed in the apparatus of FIGS. 1 and 2 are well-known, they are shown schematically and their operation will be described only briefly.

FIG. 1 depicts a representative developer unit 138. As shown in FIG. 1, developer unit 138 includes a housing 144 defining a chamber 176 for storing a supply of developer material therein. Donor roll 140 is comprised of conductive metal core 174, dielectric layer 180, an electrical conductor pattern 142 at the peripheral circumferential surface of the roll, and semi-conductive layer 120. The electrical conductor paths in the conductor pattern are substantially equally spaced from one another and insulated from the body of donor roll 140. Donor roll 140 rotates in the direction of arrow 168. A magnetic roller 146 is also mounted in chamber 176 of developer housing 144, and is shown rotating in the direction of arrow 192.

An alternating (AC) voltage source 100 and a constant (DC) voltage source 102 electrically bias donor roll 140 in the toner loading zone. Magnetic roller 146 is similarly electrically biased by AC voltage source 104 and DC voltage source 106. Normally both of these voltages are set to zero. The relative voltages between donor roll 140 and magnetic roller 146 are selected to provide efficient loading of toner on donor roll 140 from the carrier granules adhering to magnetic roller 146. In the development zone, voltage sources 108 and 110 electrically bias electrical conductors 142 to a DC voltage having an AC voltage superimposed thereon. Voltage sources 108 and 110 are in wiping contact with isolated electrodes 142 in the development zone. As donor roll 140 rotates in the direction of arrow 168, successive electrodes 142 advance into the development zone 112 and are electrically biased by voltage sources 108 and 110. As shown in FIG. 1, wiping brush 113 contacts isolated electrodes 142 in development zone 112 and is electrically connected to voltage sources 108 and 110. In this way, an AC voltage difference is applied between the isolated electrical conductors and the donor roll detaching toner from the donor roll and forming a toner powder cloud. Voltage 108 can be set at an optimum bias that will depend upon the toner charge, but usually the voltage is set at zero.

The electroded donor roll assembly is biased by voltage sources 114 and 116. DC voltage source 116 controls the DC electric field between the assembly and photoconductive belt 101 (moving in direction 109) for the purpose of suppressing background deposition of toner particles. AC voltage source 198 applies an AC voltage on the core of donor roll 140 for the purpose of applying an AC electric field between the core of the donor roll and conductors 142, as well as between the donor roll and photoconductive belt 101. Although either of the AC voltages 198 and 110 could be zero, other voltages must be non-zero so that a toner cloud can be formed in the development zone. For a particular toner and gap in the development zone between the donor roll and photoconductive belt, the amplitude and frequency of the AC voltage being applied on donor roll 140 by AC voltage supply 114 can be selected to position the toner powder cloud in close proximity to the photoconductive surface of belt 101, thereby enabling development of an electrostatic latent image.

It should also be noted that a wiping brush 196 engages donor roll 140 in loading zone 94. This insures that the donor roll is appropriately electrically biased relative to the electrical bias applied to the magnetic roller 146 in loading zone 194 so as to attract toner particles from the carrier granules on the surface of magnetic roller 146. Magnetic roller 146 advances a constant quantity of toner having a substantially constant charge onto donor roll 140. This insures that donor roller 140 provides a constant amount of toner having a substantially constant charge in the development zone.

Metering blade 188 is positioned closely adjacent to magnetic roller 146 to maintain the compressed pile height of the developer material on magnetic roller 146 at the desired level. Magnetic roller 146 includes a non-magnetic tubular member 186 made preferably from aluminum and having the exterior circumferential surface thereof roughened. An elongated magnet 184 is stationarily mounted within and spaced from the tubular member. The tubular member rotates in the direction of arrow 192 to advance the developer material adhering thereto into a loading zone 194. In loading zone 194, toner particles are attracted from the carrier granules on the magnetic roller to the donor roller. Augers 182 and 190 are mounted rotatably in chamber 176 to mix and transport developer material. The augers have blades extending spirally outward from a shaft. The blades are designed to advance the developer material in the direction substantially parallel to the longitudinal axis of the shaft.

FIG. 2 depicts a printing machine using an imaging member, in the form of an endless belt, according to the present invention. The printing machine shown in FIG. 2 employs an imaging member 10 in the form of an endless belt produced by the process of the present invention, which moves in the direction of arrow 12 to advance successive portions of the surface of the belt 10 through the various stations disposed about the path of movement thereof. As shown, belt 10 is entrained about rollers 14 and 16, which are mounted to be freely rotatable, and drive roller 18, which is rotated by a motor 20 to advance the belt in the direction of the arrow 12.

Initially, a portion of belt 10 passes through a charging station A. At charging station A, a corona generation device, indicated generally by the reference numeral 22, charges a portion of the surface of belt 10 to a relatively high, substantially uniform potential.

Next, the charged portion of the surface is advanced through an exposure station B. At exposure station B, the charged portion of the surface is exposed to an image, such as an image of an original document being reproduced, or to a computer-generated image written by a raster output scanner, the exposure apparatus being generally referred to as exposure apparatus 24. The specific apparatus for the exposure station is known in the art, and need not be described in further detail. The charge on the surface is selectively dissipated, leaving an electrostatic latent image on the surface that corresponds to the original document or computer image. The belt 10 then advances the electrostatic latent image to a development station C.

At development station C, a development apparatus indicated generally by the reference numeral 32 transports toner particles to develop the electrostatic latent image recorded on the surface of belt 10. The development apparatus 32 may be comprised of any of various developer housings known in the art, and may contain one or more donor rolls, shown in FIG. 2 as donor rolls 76 and 78. A typical development apparatus is described in detail in U.S. Pat. No. 5,032,872, the entire disclosure of which is incorporated herein by reference. The development apparatus may also comprise an electroded donor roll such as those of the present invention and described in detail in FIG. 1. Toner particles are transferred from the development apparatus to the latent image on the belt, forming a toner powder image on the belt, which is advanced to transfer station D.

At transfer station D, a sheet of support material 38, typically a sheet of paper or transparency, is moved into contact with the toner powder image. Support material 38 is advanced to transfer station D by a sheet feeding apparatus, indicated generally by the reference numeral 40. Preferably, sheet feeding apparatus 40 includes a feed roll 42 contacting the uppermost sheet of a stack of sheets 44. Feed roll 42 rotates to advance the uppermost sheet from stack 44 into chute 46. Chute 46 directs the advancing sheet of support material 38 into contact with the surface of belt 10 in a timed sequence so that the toner powder image developed thereon contacts the advancing sheet of support material at transfer station D. Alternatively, the support material 38 may be fed into transfer station D as a continuous sheet or web, and optionally cut into sheet form subsequent to transfer.

Transfer station D includes a corona generating device 48 which sprays ions onto the back side of support material 38. This attracts the toner powder image from the surface of belt 10 to support material 38. After transfer, the support material continues to move in the direction of arrow 50 into a conveyor (not shown) that advances the support material to fusing station E.

Fusing station E includes a fusing assembly, indicated generally by the reference numeral 52, which permanently affixes the transferred powder image to support material 38. Preferably, fuser assembly 52 includes a heated fuser roller 54 and back-up roller 56. Support material 38 passes between fuser roller 54 and back-up roller 56 with the toner powder image contacting fuser roller 54. In this way, the toner powder image is permanently affixed to the support material 38. After fusing, and optional cutting if continuous sheet or web fed, chute 58 guides the advancing support material to catch tray 60 for subsequent removal from the printing machine by the operator.

Invariably, after the support material is separated from the surface of belt 10, some residual toner particles remain adhering thereto. These residual particles are removed from the surface at cleaning station F. Cleaning station F may include a pre-clean corona generating device (not shown) and a rotatably mounted fibrous brush 62 in contact with the surface of belt 10. The pre-clean corona generating device neutralizes the charge attracting the particles to the surface. These particles are cleaned from the surface by the rotation of brush 62 in contact therewith. Subsequent to cleaning, an exposure system (not shown) may be used to dissipate any residual charge remaining thereon prior to the charging thereof for the next successive imaging cycle.

The process of the present invention provides numerous advantages and efficiencies over prior art processes used to produce electroconductive members. Among those advantages are the following:

1) Absolute resistivity and other electrical properties, as well as such physical properties as stiffness and compliance, of the insulating material layer of the electroconductive member, required for a particular application, may be obtained by simply adjusting the power and fluence of the irradiation source, rather than redesigning the insulating material itself.
2) Uniform electrical properties may be obtained during the production process, reducing the product to product variations resulting from prior art processes.
3) Conducting patterns equal to pure graphite ($10^{-3}$ ohm-cm) or lower can be achieved by using the irradiation method. And, as mentioned above, resistivity of the insulating material can be varied over a range ranging from $10^{12}$ ohm-cm or higher to $10^{-3}$ ohm-cm or less.
4) Where actual wiring patterns are needed in a layer of the electroconductive member, a single process of forming the electrically conducting wire patterns in an insulating material can replace the multi-step process of forming a separate wiring pattern.
5) Because additional chemicals and processes are not used to form the electrically conductive wire pattern or layer, there is no danger of interactions in the system or the process, and there are no waste chemicals to be disposed of. Also the introduction of defects and contaminants is reduced.
6) If highly conductive materials need to be applied, the conductive pattern formed by the irradiation process can be used as the pattern for applying the highly conductive materials such as copper or nickel.
7) If the irradiation processing is conducted as the insulating material is being applied, then the process allows for the independent control of the bulk and surface electrical properties of the insulating material.
8) Use of expensive conductive polymers for tuning the RC time constant, as well as other properties of the electroconductive member can be avoided, since the conductivity of the insulating material can be altered.

The invention will now be described in detail with reference to specific preferred embodiments thereof. All parts and percentages are by weight unless otherwise indicated.

EXAMPLES

Example 1

A donor roll is prepared using an insulating material to form the entire donor roll structure, i.e., without a conducting substrate. The core of the donor roll is a rod comprised entirely of the insulating material Torlon™ type 4203L resin (available from Amoco Company). The core has a diameter of about 1.0 inch and a length of about 14.75 inches. The surface of the roll is finished by use of a metal diamond cutting tool and buffed with a very fine abrasive cloth to obtain a fine surface finish of about 0.03 mils, which is the maximum depth of surface scratches on the roll. The roll is cleaned by wiping with a lintless cotton pad containing heptane solvent and dried at 100° C. for 30 minutes in a forced air oven. The surface of the roll is corona treated by use of the Enercon Model A1 corona surface treater. Four passes of the corona treatment head are made over the surface of the roll at a head-to-roll spacing of about 0.75 inch.

A polyimide film is coated over this thin insulating roll by dipping the insulating roll in the polyimide material. A thin polyimide layer of uniform thickness is prepared by appropriate dipping, metering and drying. The coated roll is then mounted on a mandrel and optical radiation is passed through shadow mask apertures, which expose patterns on the underlying roll coating. Multiple or individual masks, plus rotation of the coated roll under the mask(s) provide patterned exposure of the entire roll surface. Exposure is metered in terms of multiple pulse repetition at a single spot, repetition rate, and pulse duration. The exposed and patterned roll is then coated with a protective layer.

Example 2

A thin insulating roll is formed according to the process of Example 1, except that the thin insulating roll is then used to form an electroded bias transfer member. As in Example 1, the thin insulating roll is coated with a thin uniform polyimide film by dipping the insulating roll in the polyimide material. The coated roll is then mounted on a mandrel and irradiated. In this Example, the irradiation is metered to provide an electrode pattern on the coated roll adequate for use as an electroded bias transfer member. The exposed and patterned roll is then coated with a protective layer.

Example 3

A thin insulating roll is formed according to the process of Example 1, except that the thin insulating roll is then used to form a bias transfer member. As in Example 1, the thin insulating roll is coated with a polyimide film by dipping the insulating roll in the polyimide material. The coated roll is then mounted on a mandrel and irradiated. In this Example, the entire surface of the polyimide layer is irradiated to produce a uniform surface with identically treated properties. The exposed and patterned roll is then coated with a protective layer.

Example 4

A three-layer imaging member is formed having a core substrate material, a conductive charge generating layer, and a resistive charge transport layer. The core of the imaging member is a rod comprised entirely of the insulating material Torlon™ type 4203L resin (available from Amoco Company). The core has a diameter of about 1.0 inch and a length of about 14.75 inches. The surface of the roll is finished by use of a metal diamond cutting tool and buffed with a very fine abrasive cloth to obtain a fine surface finish of about 0.03 mils, which is the maximum depth of surface scratches on the roll. The roll is cleaned by wiping with a lintless cotton pad containing heptane solvent and dried at 100° C. for 30 minutes in a forced air oven. The surface of the roll is corona treated by use of the Enercon Model A1 corona surface treater. Four passes of the corona treatment head are made over the surface of the roll at a head-to-roll spacing of about 0.75 inch.

A first polyimide film is coated over this thin insulating roll by dipping the insulating roll in the polyimide material. A thin polyimide layer of uniform thickness is prepared by appropriate dipping, metering and drying. The coated roll is then mounted on a mandrel for optical irradiation. In this example, the first polyimide layer is irradiated with optical radiation passed through shadow mask apertures to irradiate the entire area of the underlying roll coating. Multiple or individual masks, plus rotation of the coated roll under the mask(s) provide complete exposure of the entire roll surface. Exposure is metered in terms of multiple pulse repetition at a single spot, repetition rate, and pulse duration. The result is a coating of polyimide material on the core, wherein the polyimide has a set uniform volume resistivity between $10^6$ and $10^{10}$ ohm-cm.

The coated structure is next coated with a second polyimide film and is processed similar to the first polyimide layer. For the second layer, the processing is adjusted to provide a set uniform volume resistivity between $10^{12}$ and $10^{14}$ ohm-cm.

Example 5

A nominally three-layer imaging member is prepared similar to the imaging member of Example 4, except that only a single layer of polyimide is applied to the core structure. In this Example, the laser processing is adjusted by making two passes with the laser beam. In the first pass, a higher wavelength irradiation source is used to provide deeper penetration of the energy and to adjust the electrical properties of the sub-surface portion of the polyimide film. This processing thus effectively forms a distinct layer within the polyimide film wherein this "layer" has a set uniform volume resistivity between $10^6$ and $10^{10}$ ohm-cm. A lower wavelength irradiation source is then used to irradiate the surface portion of the polyimide film, to effectively provide a second distinct "layer" within the polyimide film wherein this "layer" has a set uniform volume resistivity between $10^{12}$ and $10^{14}$ ohm-cm.

What is claimed is:

1. A method for forming an electroconductive member for electrostatographic development, comprising:

(a) forming a roll having a layer of an insulating material; and (b) altering an electrical property of said insulating material by irradiating the insulating material with a laser beam, before or after said step (a).

2. The method according to claim 1, wherein said step (b) comprises irradiating the insulating material with a laser selected from the group consisting of ultraviolet lasers, free electron lasers, ion beam lasers, infrared lasers, and visible light lasers.

3. The method according to claim 1, wherein said insulating material comprises at least one of Buckminsterfullerene and a polymer selected from the group consisting of polyimide, polybenzimidazole, polyamide-imide, and mixtures thereof.

4. The method according to claim 1, wherein said insulating material comprises a ceramic selected from the group consisting of silicon carbide, aluminum nitride, silicon nitride, alumina, boron nitride, boron carbide, beryllia, titania, and mixtures thereof.

5. The method according to claim 1, wherein said step (b) comprises altering conductivity of portions of said insulating material, said portions forming a pattern of electrically conductive pathways in said insulating layer.

6. The method according to claim 5, comprising locating said electrically conductive pathways equally spaced from one another, parallel to a long axis of the roll, and arranged about a peripheral circumferential surface of the electroconductive member.

7. The method according to claim 5, wherein said electroconductive member is a donor roll and said conductive pathways have a conductivity sufficiently different from a conductivity of a remainder of said insulating material such that the conductive pathways may be electrically biased to detach toner triboelectrically adhering to a surface of the donor roll, thus to form a cloud of toner for development of a latent image with the toner.

8. The method according to claim 5, wherein said electroconductive member is a bias transfer roll and said conductive pathways have a conductivity sufficiently different from a conductivity of a remainder of said insulating material such that the conductive pathways may be electrically biased to detach toner particles from a latent image on an imaging member and to attract those particles to a surface of a recording substrate positioned adjacent said bias transfer roll.

9. The method according to claim 1, wherein said step (b) comprises irradiating portions of said insulating material layer with multiple bursts of said laser beam.

10. The method according to claim 9, wherein said portions are irradiated by between 1,000 and 6,000 bursts from said laser beam at a frequency of from about 1 burst per ten seconds to about 100 bursts per second.

11. The method according to claim 9, wherein said bursts from said laser beam have a fluence at the insulating material of from about 10 mJ/cm$^2$ per pulse to about 300 mJ/cm$^2$ per pulse.

12. The method according to claim 1, wherein said step (b) comprises irradiating portions of said insulating material layer with only a single burst of said laser beam.

13. The method according to claim 1, wherein said step (b) comprises altering conductivity of an outer portion of said layer of said insulating material.

14. The method according to claim 1, wherein said step (b) comprises altering conductivity of an entire depth of said layer of said insulating material.

15. The method according to claim 1, wherein said step (b) comprises irradiating the insulating material until a bulk resistivity of said material is between about $10^6$ ohm-cm and about $10^{10}$ ohm-cm.

16. The method according to claim 1, wherein said step (a) comprises the step of applying a layer of an insulating material to a surface of a second layer selected from the group consisting of a substrate, a conductive layer, a blocking layer, an adhesive layer, a charge generating layer, a charge transport layer, a conductive ground strip layer and an anticurl back coating layer.

17. The method according to claim 16, wherein said second layer is a substrate core material comprising one of polyurethane foam and a conductive metal selected from the group consisting of nickel, aluminum, steel, iron, and mixtures thereof.

18. An electroconductive member for electrostatographic development produced by the process of claim 1.

19. The electroconductive member of claim 18, wherein said electroconductive member is a member selected from the group consisting of a scavengeless electrode development donor roll, a scavengeless interdigitated development donor roll, a bias transfer roll, a drum-shaped electrostatographic imaging member, and an endless belt.

20. The electroconductive member of claim 18, wherein said electroconductive member is an imaging member and further comprises a heating means to heat said imaging member.

* * * * *